US006568952B1

(12) United States Patent
Tomasino

(10) Patent No.: US 6,568,952 B1
(45) Date of Patent: May 27, 2003

(54) T-TAP CONNECTOR

(75) Inventor: Guy Tomasino, Poplar Bluff, MO (US)

(73) Assignee: Swenco Products, Inc., Poplar Bluff, MO (US)

( * ) Notice: Subject to any disclaimer, the term of this patent is extended or adjusted under 35 U.S.C. 154(b) by 0 days.

(21) Appl. No.: 09/920,328

(22) Filed: Aug. 2, 2001

Related U.S. Application Data

(60) Provisional application No. 60/222,590, filed on Aug. 2, 2000.

(51) Int. Cl.[7] ..... H01R 4/24
(52) U.S. Cl. ..... 439/411; 439/425
(58) Field of Search ..... 439/411–414, 417–419, 439/425, 426, 427, 428, 801

(56) References Cited

U.S. PATENT DOCUMENTS 2,567,783 A * 9/1951 Richardson ..... 439/411
2,759,095 A * 8/1956 Kline ..... 439/412
3,602,872 A * 8/1971 Braunstein ..... 439/412
3,877,773 A * 4/1975 Doty et al. ..... 439/412
3,902,780 A * 9/1975 Dola ..... 439/412
3,951,503 A * 4/1976 Caulkins ..... 439/411
4,878,855 A * 11/1989 Heng et al. ..... 439/411
5,228,875 A 7/1993 Swenson, Sr. ..... 439/784
5,695,369 A 12/1997 Swenson, Sr. ..... 439/784
5,789,706 A 8/1998 Perkins ..... 174/65 R

* cited by examiner

*Primary Examiner*—Hien Vu
(74) *Attorney, Agent, or Firm*—Jim Zegeer

(57) ABSTRACT

A T-tap connector for making connection of a main electrical conductor without stripping the insulation or without splicing. A housing member has a plurality of connection chambers with an internally threaded wall and a central axis, a common connection member mounted in a wall separating the connection chambers. One of the connection chambers is slotted so that the walls thereof serve as ratchet teeth and coact with a coupling member to force a wire into engagement with a sharp pointed, common conductive member.

2 Claims, 2 Drawing Sheets

T-TAP CONNECTOR

REFERENCE TO RELATED APPLICATION

The present application is the subject of provisional application Ser. No. 60/222,590 filed Aug. 2, 2000 entitled T-TAP-IN CONNECTOR.

BACKGROUND AND BRIEF DESCRIPTION OF THE INVENTION

The present invention relates to a wire connector for tapping to a wire particularly low-voltage hot-wire such as in a vehicle 12-volt and 24-volt systems. The invention also pertains to tapping into wires without severing or splicing the wire. In the prior art, tapping into a main or a hot wire or tying wires together is frequently done by one cut of the main wire and stripping the insulation from the wire ends and twisting or crimping the three (or more) wires together. A further technique in the prior art is to strip the insulation off the main or hot wire and wrap and solder the accessory wire thereon and then cover them with heat-shrink to reinsulate them. A third technique is used "Scotch Lok" (TM) type connector which taps into each wire with a blade shape that can in some instances destroy the wire strands and easily come apart.

An object of the present invention is to provide a T-tap into a wire without severing the wire or splicing the wire or with unusual tools or stripping the hot wire.

A further object of the invention is to provide a T-tap into an insulated main which substantially maintains the integrity of the main wire.

A further object of the invention is to provide a T-tap connector which will not pull apart or vibrate.

A further object of the invention is to provide a T-tap connector which has significantly less resistance than crimping or soldering into a T-tap.

According to the invention, a cylindrical female body member has a pair of connection chambers, one chamber which is provided in a form as substantially disclosed in U.S. Pat. No. 5,228,875, incorporated herein by reference. As disclosed in that patent, a common conductive member extends between the two connection chambers. In the present invention, instead of a bullet-shaped end in one of the connection chambers, that connection chamber is provided with a conductive member portion that has a needle sharp point for piercing the insulation and into the stranded conductors of a so-called main wire. A notch or slot in the female and/or male body allows the wire to be positioned onto the bullet needle sharp point, and when the male end member is pressed in place, the wire is held and pressed between the male and female members, causing the sharp point to pierce through proximate the center of the insulation to the conductor strands. Due to U-shaped notches or slots in the threaded portions, the threaded portions are spring-like and ratchet to lock the wire in the notches or slots with the needle-sharp point electrically engaging the conductive wire strand(s). Due to the needle shape of the bullet, the wire strands are pushed around it making full electrical contact. No wire strands are broken and the wire integrity is maintained. Thus, there is provided a method and apparatus for tapping into hot wires without splicing or stripping into the hot wire. The invention is particularly applicable to low voltage situations (automotive, boats, planes, etc.) where tapping in hot wires is sometimes desirable but is not limited to low voltage applications.

In all cases, for safety it is highly advisable to remove power from the circuit in which the "hot wire" is located so that the connection is made while there is no power on the wire.

DESCRIPTION OF THE DRAWINGS

The above and other objections, advantages and features of the invention will become more apparent when considered with the following specification and accompanying drawing, wherein.

DETAILED DESCRIPTION OF THE INVENTION

Figure 1:
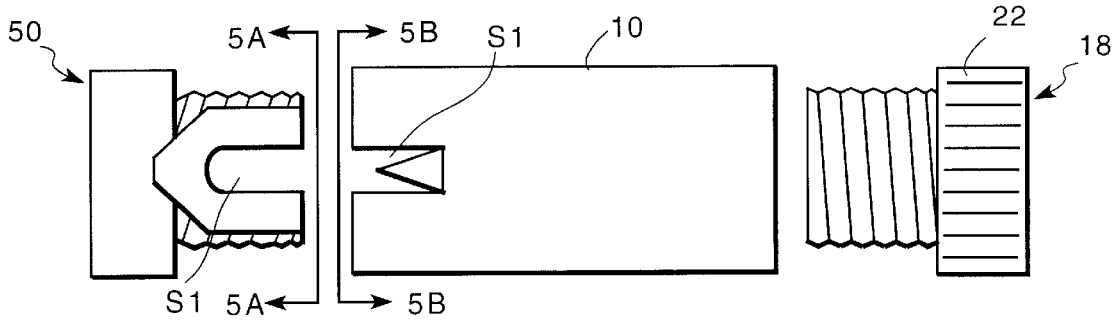
FIG. 1 is an enlargement of a side elevational view of a T-tap connector incorporating the invention.
Figure 2:
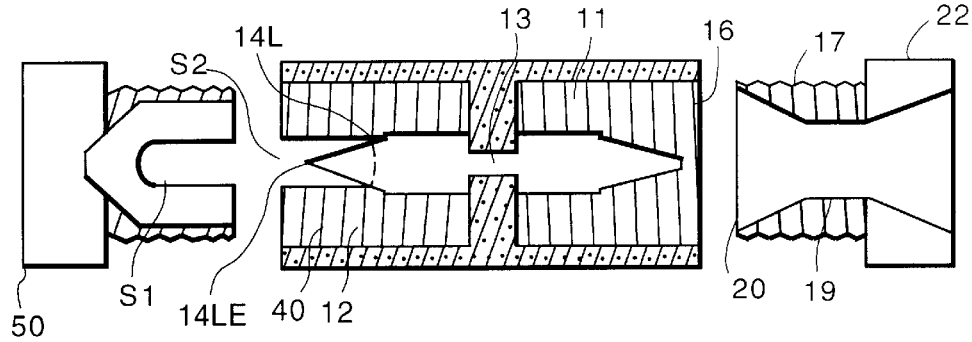
FIG. 2 is a sectional view thereof.
Figure 3:
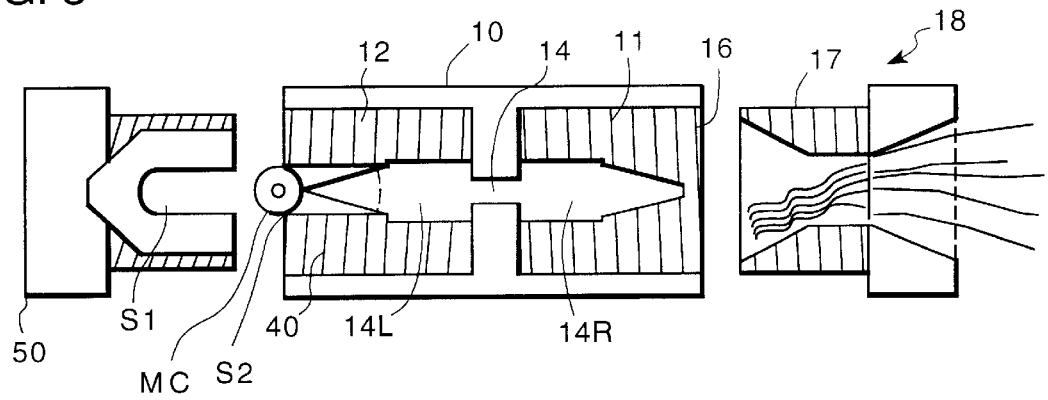
FIG. 3 is a sectional view showing the positioning of the wires to be connected together with the main or hot wire running vertically in the drawing.
Figure 4:
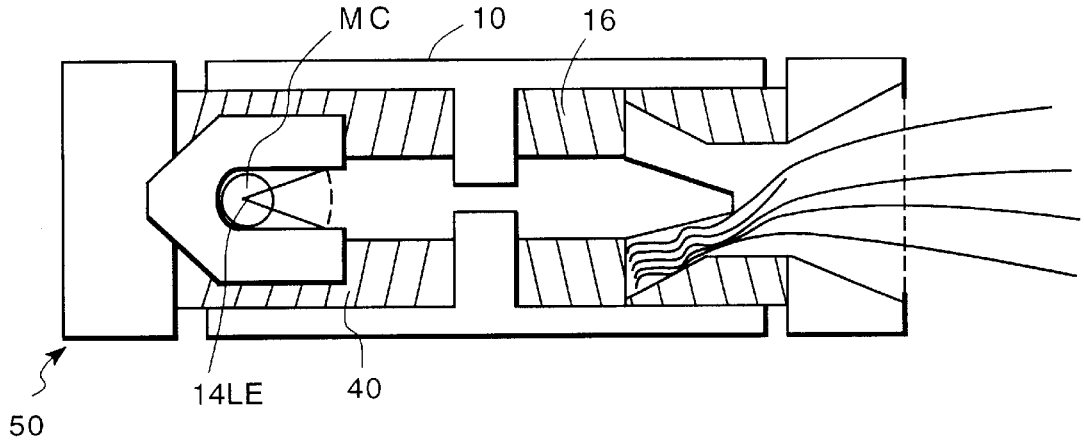
FIG. 4 is a sectional view showing the wires in an installed position in one embodiment of the invention.

Referring now to FIGS. 1 and 2, a T-tap electrical connector is shown incorporating the invention in which a cylindrical female member 10 has a pair of connection chambers 11 and 12 therein divided by a bullet-mounting wall 13 which rigidly supports a conductive bullet member 14 having left and right ends 14L and 14R, respectively. The right end 14R and a connection chamber 11 are similar to the connection chamber disclosed in Swenson U.S. Pat. No. 5,695,369. Chamber 11 has an internally threaded wall 16 which is adapted to being threadably engaged with threads 17 on non-conductive male coupling member 18. Non-conductive male coupling member 18 has a throughbore 19, with one end 20 of throughbore 19 being conical and adapted to coact with conical end 14R of bullet 14 to clamp wires therebetween as disclosed in U.S. Pat. No. 5,695,369 and U.S. Pat. No. 5,228,875 incorporated herein by reference. The right end of the throughbore 19 is flared outwardly and is adapted to receive at least one and preferably two to three wires, the ends of which are stripped of insulation and twisted together to make electrical contact with the conductive end 14R of the conductive bullet 14. In use, when the external threads 17 are engaged with internal threads 16 in conduction chamber 11, the wires shown in FIGS. 3 and 4 are clamped tightly between the conductive bullet surface 14R and the clamping wall 20 of connection member 18.

The right end 22 of connection member 18 is knurled so as to provide easy gripping. Body member 10 may also be knurled or roughened or provided with thumb wings to enhance the force supplied by the fingers to provide secure clamping or locking the twisted wire ends TWE securely in place.

Figure 5A:
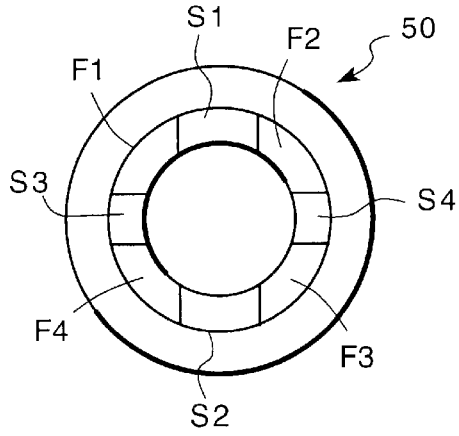
FIG. 5A is a view taken on line 5A—5A in FIG. 1.
Figure 5B:
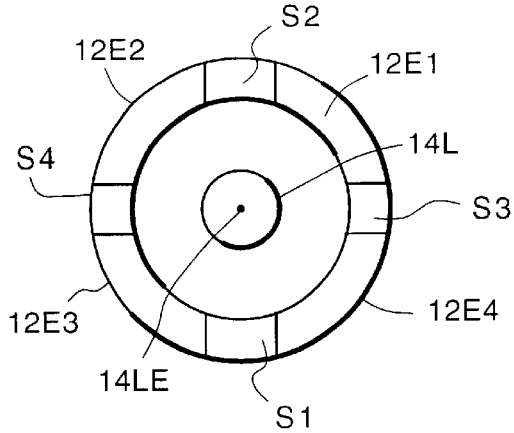
FIG. 5B is a view taken on line 5B—5B in FIG. 1.

The opposing end, connection chamber 12, has internally threaded walls 40 and houses the protruding end 14L of the bullet conductor 14. Instead of being bullet-shaped, end 14LE is sharpened to a point and so that it is easily capable of piercing the insulation on a main conductor MC which is to be tapped (FIGS. 4, 5). For this purpose, notches or slots S1, S2, S3 and S4 are provided in the walls of connection chamber 12. Slots S1, S2, S3 and S4 provide or serve two functions:

1. They provide a notch into which to receive the main wire MC so as to center it exactly on the point of 14L of conductor member 14L (note that the tip or sharpened point of bullet end 14L is positioned somewhat below the leftward end of a slot so that the wire MC can be positioned directly on the sharpened point and held in position while the coupling member 50 is fitted in place), and 2. Serve as to render the remaining portions F1, F2, F3 and F4 of the housing 12-E1, 12-E2, 12-E3 and 12-E4 as spring fingers so that the internally threaded portions of the housing act as spring ratchet fingers.

A second non-conductive coupling member 50 is provided for pressing the main conductor wire MC into engagement with the sharp point 14L so as to cause the point to pierce the insulation of main conductor MC to engage the conductive wire (either stranded or non-single solid conductor). Coupling member 50 is provided with a set of slots 51, 52, 53, 54 which, like the slots S1, S2, S3, S4 in the housing member 12, make the remaining portions of the coupling member 50 which have the threaded external surfaces thereon serve as ratchet teeth which coact with the ratchet spring fingers on housing member 12 to spring inwardly as the ratchet spring fingers on the coupling member 50 spring outwardly thereby to ratchet the coupling member 50 as it is pressed inwardly and locked step-by-step thereby forcing the wire step-by-step into positive engagement with sharpened point 14LE.

As illustrated, slots S1 and S2 may have different widths than slots S3 and S4, and slots 51 and 52 can have different widths than slots 53 and 54 so as to accommodate different ranges of wire sizes.

In the preferred embodiment, the T-tap connector of this invention has a non-conductive body member 10 and coupling members 25 and 50 which are made of nylon with preferably fifteen percent glass fiberfill. The conductive bullet preferably is 360 brass.

Thus, there has been provided a T-tap connector having a U-groove in the female or male body to allow the wire to be positioned into the bullet's needle-sharp point 14LE when the male end is pressed in place. When the wire is pressed between the male and female members, the bullet point pierces through the center of the wire insulation. Due to the U-shaped screws or slots in the threaded portions, the remaining portions serve as spring-like ratchet fingers themselves to lock the wire in the grooves with the needle-sharp point shape of the bullet. And the wire strands are pushed around it making full electrical contact. The wire strands are broken, and the main wire MC integrity is maintained.

One or more accessory wires is then stripped and inserted into the opposing end of the connector coupling member 25 and locked as in U.S. Pat. No. 5,228,875.

The T-tap-in connector of this invention has many uses. For extending all "hot wires" without splicing or stripping into the hot wire. It can be used for automobile add-on's, such as alarms, lighting and stereos.

The present invention is superior to prior art T-tap techniques in that:

1. It has the ability to tap into wire without tools, splicing or stripping of the main wire insulation.
2. It has maintained integrity of the hot wire without exposing the user to voltage.
3. The wire strands of the main wire remain intact.
4. Tap-in into the hot lead MC will not pull apart or vibrate loose.
5. There is less resistance as compared to crimping or soldering.

While the preferred embodiment of the invention has been shown and described, it will be apparent to those skilled in the art that other modifications, adaptations and changes to the invention will be readily apparent to those skilled in the art.

What is claimed is:

1. A T-tap connector for connecting into a main insulated conductor wire comprising: a non-conductive housing member having a plurality of connection chambers, a wall separating said connection chambers, each connection chamber having an internally threaded connection wall and a central axis, a common conductive member mounted in the wall separating said connection chambers, said common conductive connector member having a bullet-shaped end surface on one end thereof and an insulation-piercing sharp point on the opposite end thereof, and said ends being in and surrounded by respective connection chambers, a plurality of slots formed in one end of the internally threaded connection wall surrounding said sharp point on said common conductive connection member and portions adjacent to the slots formed spring ratchet fingers, a first non-conductive coupling member having an externally threaded annular wall and an internal throughbore, said throughbore having first and second ends, the first end of said throughbore having a first conically shaped annular wall surface, said first conically shaped wall surface being spaced a variable distance apart from bullet-shaped connector end surfaces when said internally threaded connection wall and said externally threaded annular wall are engaged, said first and second ends of said throughbore being dimensioned to receive at least one bare wire end for the purpose of connecting to said main conductor, a second non-conductive coupling member, said second non-conductive coupling member having an external surface which is adapted to engage with the internally threaded connection wall on said connection chamber surrounding said sharp point, said second non-conductive coupling member being hollow and having slots forming spring fingers, said second non-conductive coupling member being adapted to engage with said internally threaded connection wall and to press said main conductor wire into engagement with said sharp point when said spring fingers engage with said spring ratchet fingers and thereby to lock the main insulated conductor wire in a pair of slots in said internally threaded connection wall with the sharp point electrically engaging the wire strands of said main insulated conductor wire, wherein at least a pair of slots of said second non-conductive coupling member are alignable with said pair of slots in said internally threaded connection wall.

2. The T-tap connector as defined in claim 1 wherein said sharp point is below the end of said plurality of slots.

* * * * *